United States Patent [19]

Toran

[11] 4,041,878

[45] Aug. 16, 1977

[54] SPEED AND TRACK CURVATURE SUSPENSION CONTROL SYSTEM

[75] Inventor: Angel Toran, Madrid, Spain

[73] Assignee: Patentes Talgo, S.A., Madrid, Spain

[21] Appl. No.: 567,375

[22] Filed: Apr. 11, 1975

[51] Int. Cl.[2] ..... B61F 3/12; B61F 5/24; B61F 5/38; B61F 5/50

[52] U.S. Cl. ..... 105/164; 105/4 R; 105/165; 105/199 R

[58] Field of Search ..... 105/4 R, 164, 199 R, 105/176, 165

[56] References Cited

U.S. PATENT DOCUMENTS

| | | | |
|---|---|---|---|
| 2,095,677 | 10/1937 | Schoepf et al. | 105/164 |
| 2,217,034 | 10/1940 | Van Dorn | 105/4 R |
| 2,252,789 | 8/1941 | Van Dorn | 105/4 R |
| 2,474,471 | 6/1949 | Dolan | 105/164 |
| 2,633,811 | 4/1953 | Poage | 105/164 X |
| 3,844,225 | 10/1974 | DiMajo | 105/199 R X |
| 3,911,830 | 10/1975 | Adams | 105/176 X |
| 3,918,369 | 11/1975 | Kitoaka et al. | 105/164 |

*Primary Examiner*—Robert J. Spar
*Assistant Examiner*—Howard Beltran
*Attorney, Agent, or Firm*—Eric Y. Munson

[57] ABSTRACT

A pendular suspension system for vehicles running on railroad tracks, which comprises resilient means for tilting the vehicles in response to unbalanced centrifugal force, located symmetrically on either side of a central vertical longitudinal plane of the vehicles and being independent of one another. Resilient means are arranged to bear upon a base located above the center of gravity of the vehicle bodies and are able to yield vertically and horizontally in response to the resultant imbalance of the centrifugal force to induce increased tilt of the vehicle bodies in addition to the normal cant when the vehicles travel around a curve and become operative only when the train reaches a speed above a predetermined minimum and only when the track has a predetermined degree of curvature to thereby reduce the passenger feeling of unbalanced centrifugal force.

6 Claims, 6 Drawing Figures

SPEED AND TRACK CURVATURE SUSPENSION CONTROL SYSTEM

BACKGROUND OF THE INVENTION

The present invention relates to a vehicle suspension system which ensures a suitable vehicle inclination matching the track curvature so as to counterbalance the centrifugal force acting upon the floor bearing level of the vehicle.

It is applicable to railway vehicles, more particularly to so-called articulated trains in which the coupling between vehicles prevents relative lateral movements and in which the running gear and suspension components are located within the free space between vehicles.

It is well known that one of the factors limiting the speed of trains on curves is the maximum permissible acceleration in a lateral direction, to which passengers can be subjected within the bounds of comfort.

Part of the centrifugal acceleration is counteracted by grading the roadbed of the track, that is the cant at the curves, so that passengers are only subjected to the centrifugal acceleration in the vehicle plane.

Nevertheless, since the extent of cant has to be limited to a maximum value to allow sharing of the tracks by both fast and slow trains and to allow for possible stopping on a curve, the cant alone tends to be insufficient, particularly in the case of fast trains run on tracks with limited radius of curvature. This is particularly important in areas or countries with an irregular topography.

In addition to the insufficient cant, there is unfavourable effect of the vehicle sloping towards the outside of the curve in the event the suspension being distorsed because of its normal location on a plane considerably below the centre of gravity of the suspended mass.

This tilt is greater than might be assumed on first impression, and is an inherent characteristic of each vehicle. It is defined as a coefficient representing the ratio, between the angle formed by the body in relation to the track when the train is stationary on the track, and the relevant angle of cant. In the case of conventional trains, the normal value of the coefficient is 0.4 which means that 40% of the favourable effect of the cant is lost, when running on a track with an insufficient cant of the same magnitude as the relevant cant.

A procedure for achieving total compensation for the centrifugal force from a passenger viewpoint, consists in producing a pendular oscillation of the coaches, the longitudinal axis of rotation being located above the centre of gravity. Such purely pendular vehicles, which have not gone beyond the experimental stage, have a number of disadvantages, of which the most important is the lack of stability against rolling as the use of shock-absorbers to correct this defect will only serve to delay the tilting of the vehicle upon entering a curve.

Other known apparatus employ artificial automatic control arrangements with centrifugal or other types of controls, installed to detect the curve and transmit a signal to servo-controls which ensure the tilting of the coaches. In spite of the obvious advantages, they all suffer from delayed tilting on entering curves, due to the time required to ascertain that the vehicle is in fact approaching a curve and that the signal is not produced simply by accidental movement of the vehicle, and also due to the time required to produce the actual tilting.

As a solution of the problem, the installation of a programmed computer in the vehicle, following the track characteristics, has also been tried. However, this manner of solution raises the cost even further.

SUMMARY OF THE INVENTION

The present invention solves the aforementioned problems and others principally by locating the suspension above the track, at a level above the centre of gravity of the vehicle. In this manner, a negative flexibility coefficient is achieved, and an inclination is produced towards the inside of the curve equal to an additional cant of the track.

By taking into account to the distance between springs, their height above the centre of gravity, their flexibility characteristics, etc., it is possible to achieve, within a wide margin, the most suitable ratio between required acceleration compensation by tilting and the non-compensated acceleration to be tolerated by the coach passenger.

For this purpose any type of spring can be used which is being able to be deflected either vertically or laterally in such a way that the suspended body may get a tilted position in order to partially compensate the centrifugal force.

These springs or resilient means may be part of the suspension of the corresponding body or of a suspension system common to two adjacent bodies. These springs or resilient means may also be applied to any type of running gear either with two, four or more wheels.

When the train travels around curves, relative rotation between the vehicle bodies and their corresponding running gear are produced about their vertical axis, wherefor the aforementioned springs will have to deflect in a longitudinal direction to allow for the corresponding movements.

This deflection in a longitudinal direction may also be required even on a straight track while the brakes are applied in order to resiliently balance the braking torque with the additional advantage of dampening the vibration transmission.

Although any type of suitable spring may be used, in the following description we shall refer to one particular application of the invention using diaphragm air spring on a Talgo type running gear.

We shall later on refer to other possible modifications within this particular application.

Other particular applications based on this invention could be easily derived from the present description without it being necessary to describe them in detail.

The air spring, besides the advantage of lacking the undesirable vibration of the conventional helical springs, has the additional advantages of being easily adjustable to the height of the vehicles through level adjustment valves and of preventing tilting of the vehicles due to unsymmetrical loads.

In this particular case, and following the normal layout, each spring has a level adjustment valve maintaining the spring height. The operation outlined herein is for a straight track. When negotiating a curve, the valves close and the springs are distorted vertically until the torque produced by centrifugal force is balanced, thus resulting in the tilting of the coach. When travelling around wide curves as well as at low speed which has little effect on the tilt of the coach, the operating conditions are the same as for straight-line travel.

Closure of the valves can be effected by electro-magnetic means controlled by equipment which senses whether or not the curve radius is smaller than the predetermined limit and whether or not the speed is in excess predetermined limit which are the conditions to be met for the valves to close. These simple means are described in greater detail at a later stage.

A number of the advantages of the system can be described as follows:

The inclination is achieved naturally by flexible distortion of the spring, not artificially or compulsorily by means of hydraulic cylinders or other actuating media. No additional force whatsoever is required to achieve this inclination. The compressed air consumption is lower than that of a conventional train with pneumatic suspension, the valves remaining closed when negotiating curves when the highest consumption would otherwise occur.

The inclination is gradual in accordance with the variation in the curvature of the transition curve, being at every moment proportional to the effective centrifugal force.

The centre of gravity moves the load the wheel on that side, thus decreasing the risk of derailment.

Better gauge space utilization is achieved, since the possibility of interference on the inside of the curve is eliminated, in the event the coach should tilt inwards. If the coach does not tilt owing to low speed travel or the train being stationary, the suspension spring level valves hold it parallel to the track plane, thus avoiding any interference.

Apparatus having these and other advantages are apparent from the following description of the accompanying drawings wherein:

DESCRIPTION OF A PREFERRED EMBODIMENT

Figure 1:
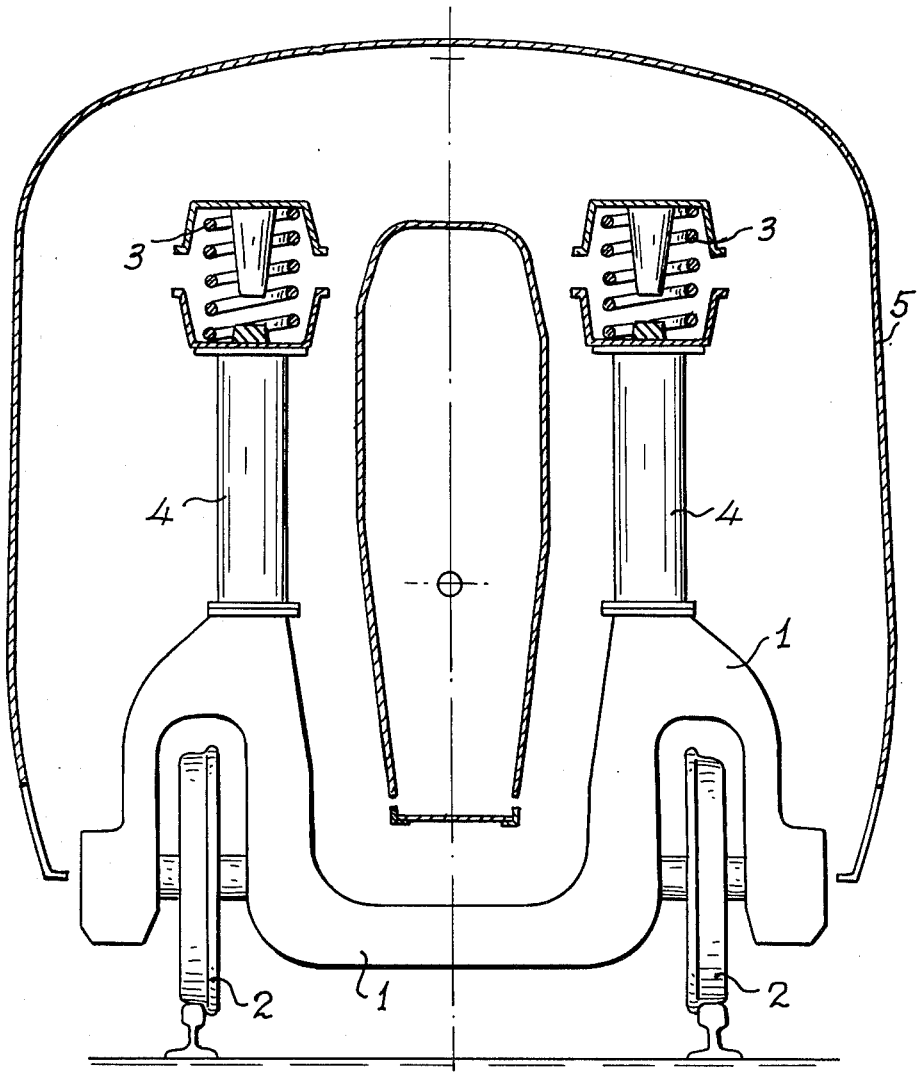
FIG. 1 is a diagrammatic transverse section through a rail vehicle constructed according to the invention and running on a straight line.
Figure 2:
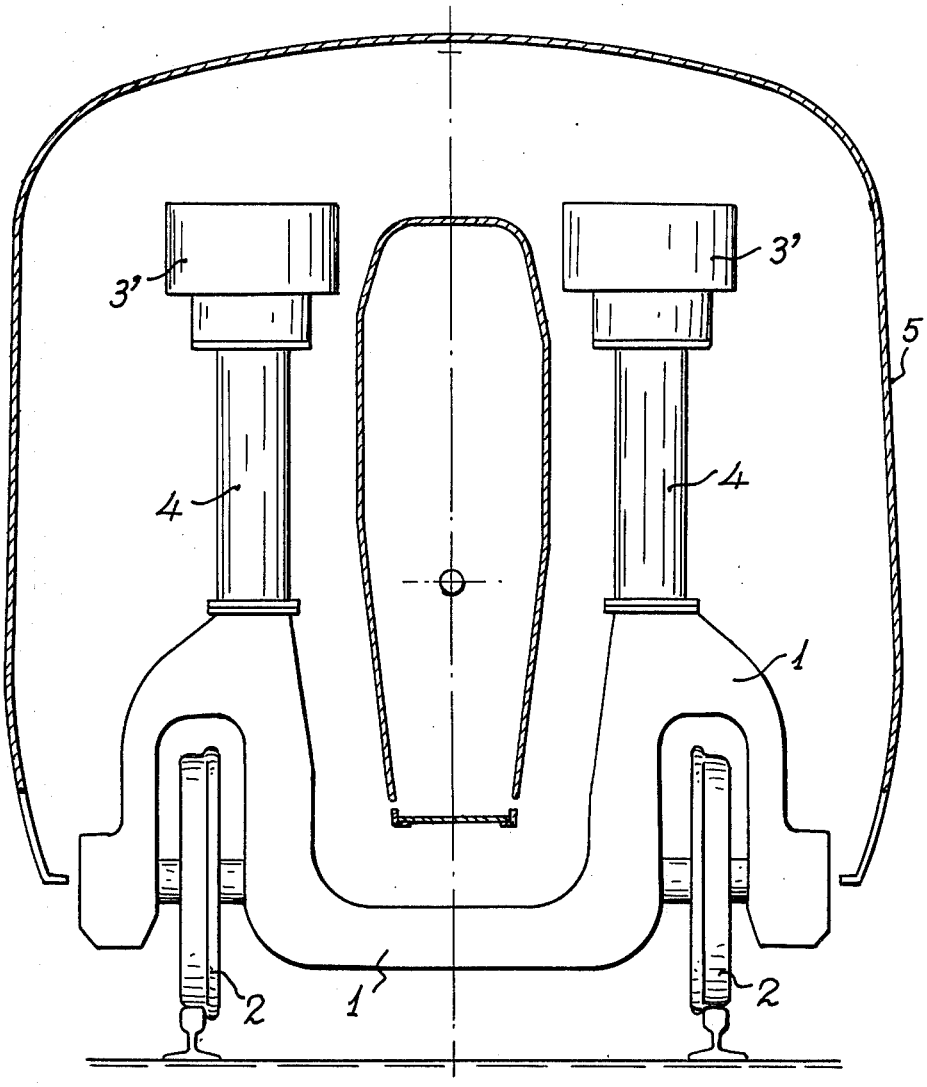
FIG. 2 shows a diagrammatic transverse section through a rail vehicle fitted with air springs while running on a straight track.
Figure 3:
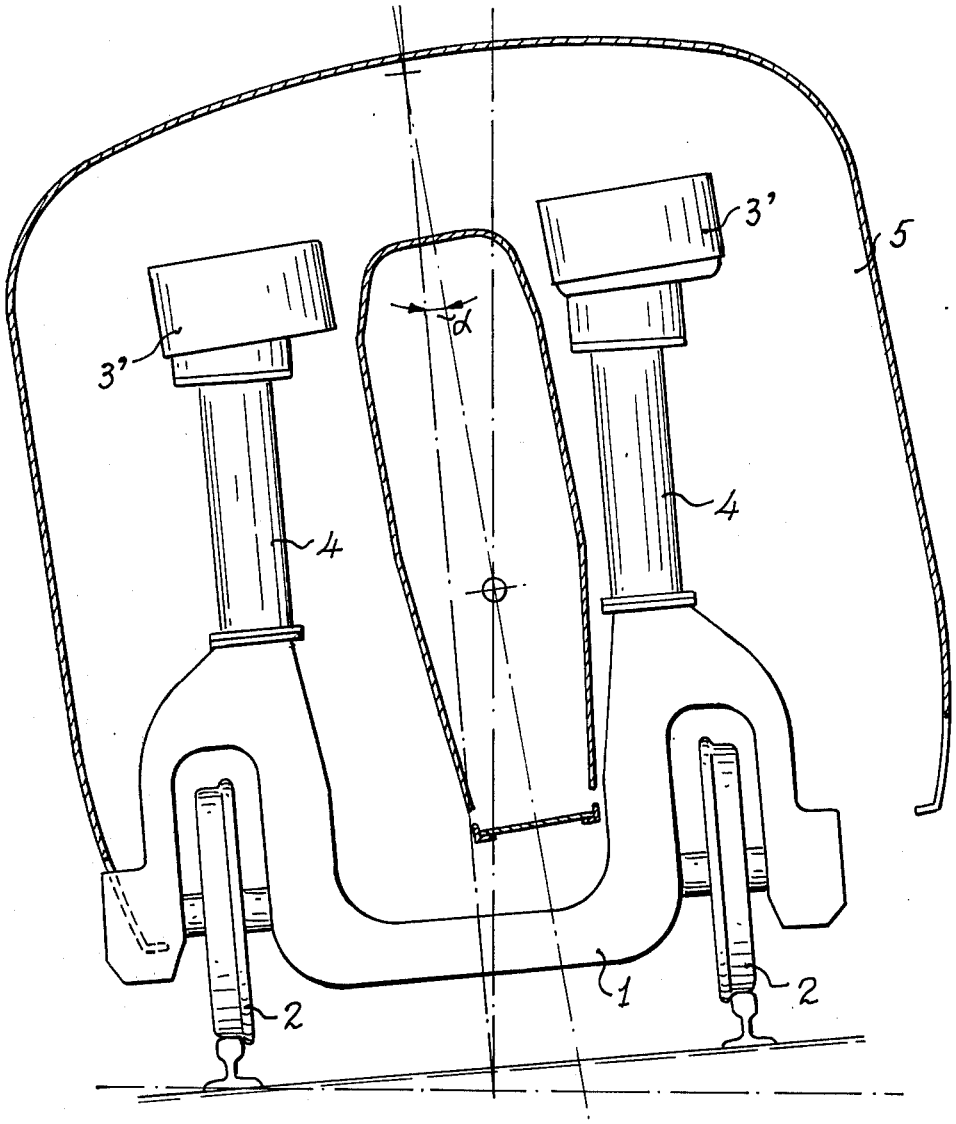
FIG. 3 is also a diagrammatic transverse section through the vehicle, but on a curve.
Figure 4:
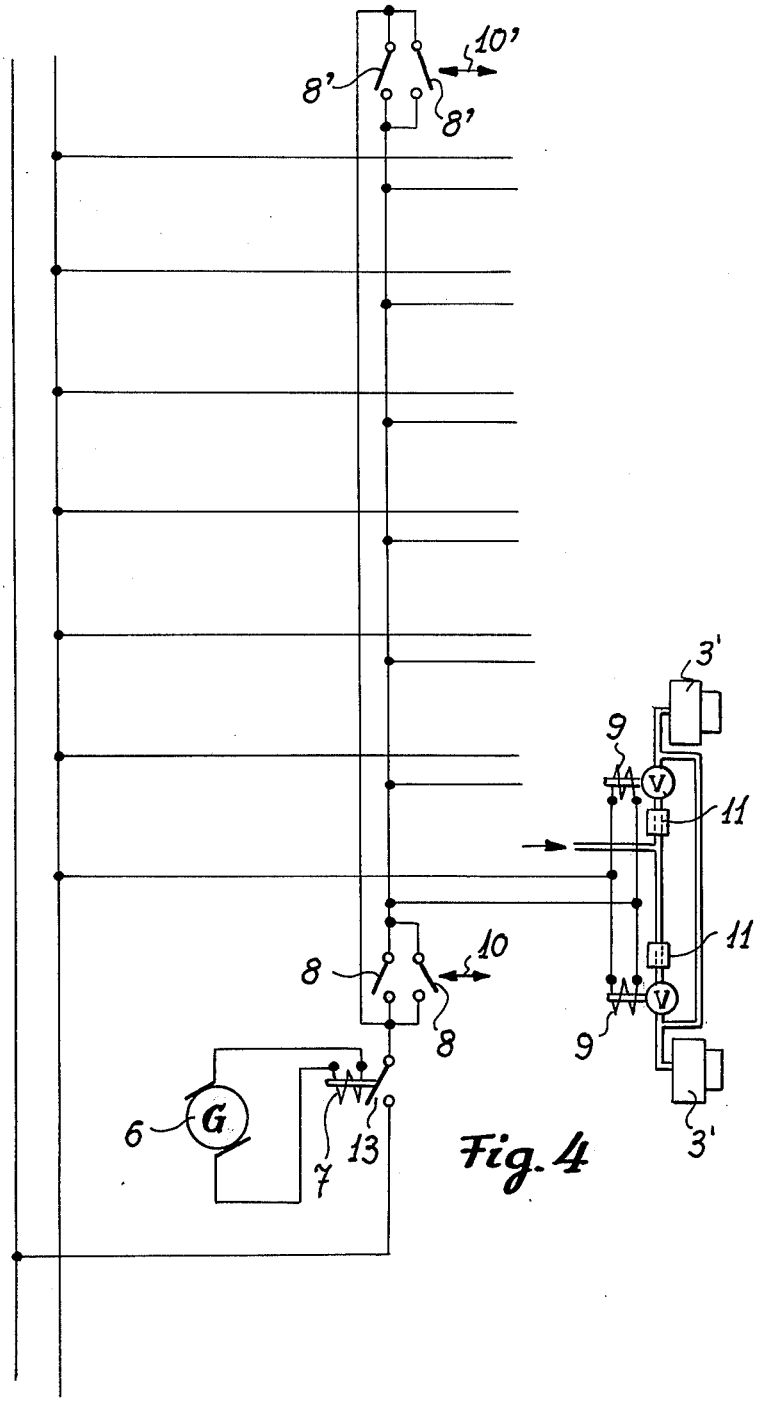
FIG. 4 shows the electrical controls diagram.
Figure 4A:
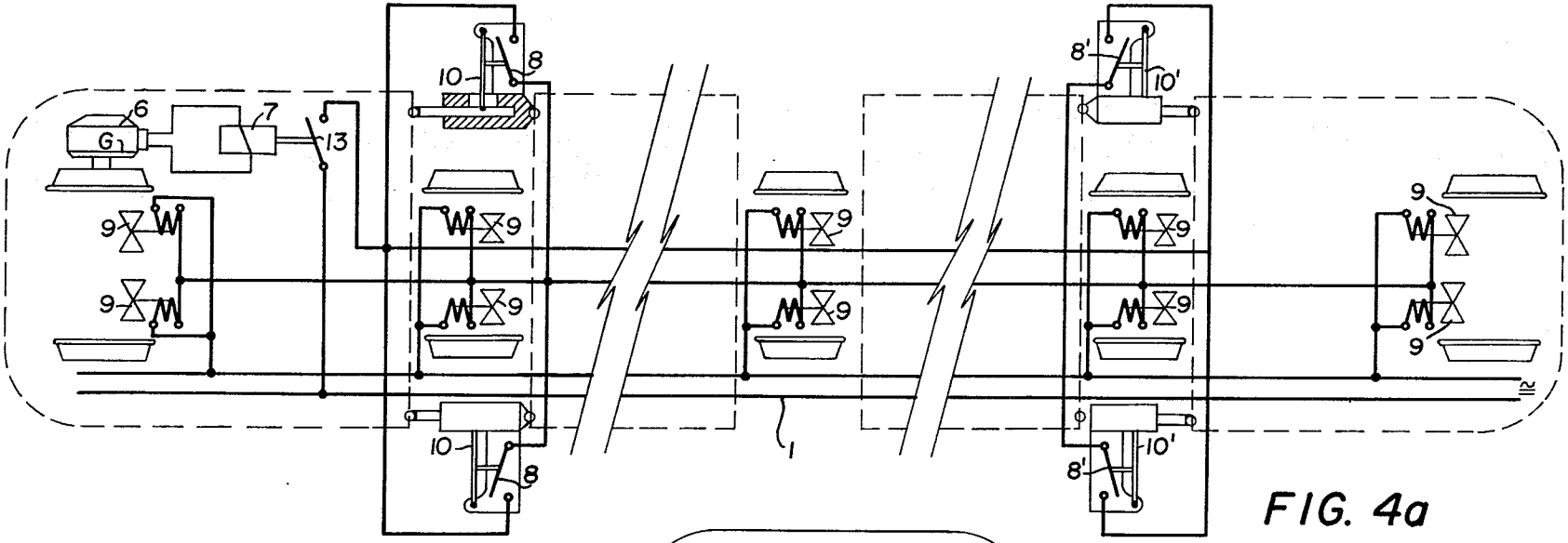
Figure 4B:
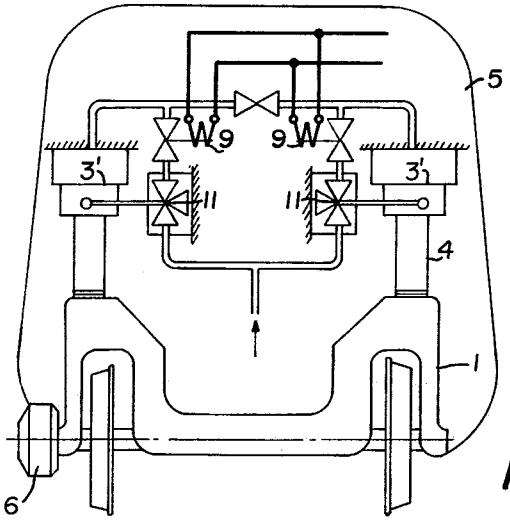

FIGS. 4*a* and 4*b* show the structural embodiments illustrated schematically in FIG. 4.

A bogie yoke or frame 1 is in the form of an inverted portal, housing the wheels 2 and serving as a support for suspension spring 3, as well as for facilitating passage from one coach to another.

In order to facilitate the manufacture of the yoke, the vertical arms 4 serving as suspension bearing, may be made independently. The said arms may be tubular and made of light alloy, and can serve as auxiliary housings 3' for the pneumatic suspension springs 3.

The vehicle body 5 bears (in a manner not shown) on the housings 3'. On straight tracks, the body 5 is maintained at a constant level within a narrow margin, above the plane of the track, by means of suspension-spring level-valve controls. When negotiating a curve this occurs also, providing the speed remains insufficient to achieve a minimum predetermined lateral acceleration. This condition applies to normal minimum radius tracks, as well as tracks having a radius sufficiently large to prevent Passenger sidcomfort when travelling at maximum speed on a straight track.

Therefore, it is necessary to detect the running speed and the curve radius, so as to trigger electro-magnetic valves 9 for cutting off level-adjustment valves 11 when specific values have been reached.

Speed can be determined by any known means, such as by an electrical generator 6 located on a wheel shaft, to produce a signal (voltage) proportional to the speed. On reaching a given voltage level, a relay 7 closes a switch 13 in the control circuit, which remains activated in the event that the train reaches a curve having a suitable radius.

The curve radius is detected by the relative angle between coaches as they enter a curve for instance, using the relative displacement of adjacent coach front ends. On reaching a minimum stipulated movement corresponding to a particular degree of curve radius, one of a number of switches 8 in respective curve sensors 10, 10' closes, and remains closed providing the relative longitudinal movement does not drop below a given predetermined minimum value.

Consequently, in order for the control circuit to be energized and thus to actuate the electro-magnetic valves 9 cutting off the level adjustment valves 11, the following two sets of conditions must be met: speed above a given limit and curve radius below a given value. Either of these conditions independently, is incapable of activating the control-circuit, thus activation will only occur when the two sets of conditions are existing together.

It should be understood that the arrangement of the energized electro magnetic solenoid valves 9 with the de-activated level control valve 11 as described, may be easily reversed in such a manner that when the electromagnetic solenoid valves 9 are de-energized, the level adjustment valves 11 are de-activated. The difference is that in the first example, if a failure should occur in the system, such as a power failure, the train is maintained in the curve and on a straight stretch so that it stays parallel to the plane of the track, and the level-adjustment valves stays open, whereas in the second example, the train cants over in the curves but the springs do not balance possible load asymmetries on a straight stretch, since the level adjustment valves 11 remain closed.

The curve detectors 10 and 10' may be located respectively at the head and at the rear of the train. This arrangement ensures action with a minimum delay in both directions. In order to deactivate the circuit, the rear detector is used in both examples.

It is important to point out that the circuit activation means that the level-adjustment valves 11 are cut-off, though this does not presuppose that the vehicle is tilting at the time nor that it will only occur in the event centrifugal force should act proportionally thereto.

An electro magnetic valve 9 for cutting off the suspension springs 3' on a curve preventing any variation in the air volume contained therein, is shown schematically in FIG. 4 interposed between the said springs 3' and associated level-adjustment valves 11.

The said level-adjustment valves 11 have a timer arrangement (not shown) in accordance with usual procedure, allowing air discharge after a given delay from the time when a variation in the air volume contained within the spring is called for following a change in load on the relevant spring. In this manner, a time delay greater than the period required for closing the valve 9 is sufficient for the springs to become operative from the start of the curve.

The intake or discharge of compressed air by the springs is only effective when, for reasons of variation in loading, the maximum or minimum heights established for the springs, are exceeded. Any variation in loading with the differential of the relevant limiting heights or levels is not translated into a variation in the compressed air volume contained within the springs. Each coach will, on a straight stretch, be in an essentially horizontal position, since it can only vary from this position within the limits of the magnitude defined by the said differential.

Another possible means of controlling the start of oscillation comprises reducing the said differential to a minute value and eliminating the delay of the level-adjustment valves 11 thus ensuring that the compressed air flow is substantially restricted. In this manner a slight variation in load would be detected by the level-adjustment valves 11.

Air would start entering the springs or would be discharged from them at a very slow rate by means of constrictors, tending to delay for a short time the return of the suspension to its nominal level. In the event of a considerable variation in loading, the air flow allowed through the level-adjustment valves 11 would also be greater.

On entering a transitional curve, the suspension progressively leaves the nominal horizontal plane and compressed air starts to enter into one spring at a slow rate, and to discharge from the opposing spring at a similar slow rate, thus endeavouring to restore the suspension to its nominal level although not until the curve-sensor equipment closes the electro magnetic solenoid valves. As a result of a suitable compressed air flow, the compressed air volume contained within the springs only suffers a negligible variation, the springs having performed as if they had been de-activated (locked) before entering the curve.

The two variations may be considered functionally equivalent, and for that reason it is only proposed to describe the procedure for the variant design with delayed operation of the level-adjustment valves 11.

The complete cycle is as follows:

It is assumed that the train is travelling on a straight stretch at a speed requiring a pendular movement. The voltage produced by the generator 6 will be greater than the minimum predetermined value, and the relay 7 will close the switch 13. The curve senser 10 at the head and the sensor 10' at the rear will be in neutral position and the switches 8 and 8' therein will be open. The coach body 5 will be parallel to the tracks plane.

On entering a curve the front ends of adjacent coach bodies will start approaching each other on the inside of the curve whilst moving away from each other on the outside. It is to be assumed that the curve detectors are designed to operate by the approach of adjacent detector heads towards each other, in which case the two switches 8 in the detector 10 are located at opposite sides of the train, so as to be alternatively actuated, depending on whether the curve is to the left or to the right.

As the train advances through the curve the front ends approach each other increasingly on the inside of the curve until the minimum longitudinal displacement at the head of the train is reached, at which point one of the switches 8 is closed thus energizing the circuit and closing the electro-magnetic valves 9 thereby preventing air from reaching the pneumatic spring or from being exhausted therefrom.

The level-adjustment valves 11 will now be in an air intake or exhaust position, from the moment of entering the curve, and a certain unbalance is created by the increasing centrifugal force. Nevertheless, the air intake or exhaust does not occur because the predetermined delay for actuating the valves has not expired, and the electromagnetic valves 9 remain energised to prevent any air movement before the delay expires.

The springs will have been airtight from the moment when the curve was first negotiated, and the body inclination will be proportional to the effective centrifugal force.

As the track radius is progressively reduced until a constant radius is reached, the centrifugal force will increase, and consequently the inclination. Centrifugal acceleration differs for each coach negotiating the transition curve according to the radius of curvature of the particular stretch of track. Coach inclination also differs, with a given degree of relative rotation between coaches, due to the effect of and the increase in track cant until the constant radius curvature is reached.

In the event of the need to brake on a curve, the centrifugal force decreases in proportion to speed and consequently the coach inclination. In the event the speed should fall below the minimum established limit the speed sensor solenoid 7 is de-energized, the switch 13 opens and the pneumatic suspension system is restored to normal function as if the train were on a straight length of track. The same occurs in the event of a curve radius should exceed the predetermined value, so that switch 8 is unable to close, and once the valve delay has expired, the train stays parallel to the track plane, just as on a straight track.

Where, instead of braking, the speed is increased on the curve, the centrifugal force is increased correspondingly with the coach inclination, always maintaining the same relationship between compensated lateral acceleration for a vehicle inclination of $\alpha$ and the uncompensated lateral acceleration to be withstood by the passenger and which distorts the suspension to produce the inclination.

This relationship is an inherent property of the vehicle design. It may vary suitably by modifying the suspension height above the centre of gravity, the distance between springs, etc.

On leaving the curve, the radius decreases progressively until a point is reached where the front of the train comes within the limit radius, thus opening the switch 8. The train inclination remains since the control circuit stays energised as one of the switches 8' at the end of the train stays closed, until the complete train has passed that point.

In the event of the train running in the opposite direction, one of the switches 8' activates the circuit on entering the curve and the appropriate switch 8 is operated on leaving the curve.

In the event of a curve in the other direction, the process is exactly the same, with the sole difference that switches 8 and 8' of the respective sensors 10, 10' for energising the circuit are those located symmetrically on the opposite side of the train.

Equally, the curve can be detected by means of the switch 8 or 8' located on the outside of the curve, in which case the switches must close as the distance between front ends is increased.

Each pair of single symmetrical switched sensors 10, 10' may also be replaced by a single sensor unit with two switches, one of which activates the circuit as the distance between front ends is reduced (in the event of a curve, towards a particular side), the other becoming operative as the distance between front-ends is increased (in the event of a curve, towards the opposite side).

What is claimed is:

1. In a pendular suspension system for use in a train having a plurality of cars, including resilient means located independent from one another symetrically on either side of a central vertical longitudinal plane of a vehicle and bearing upon a running gear frame and carrying at least one adjacent body, the resilient means bearing upon a base located above the center of gravity of the body and being able to yield vertically and horizontally in relation to the unbalance of centrifugal force, the improvement which induces an additional inclination, over that of the cant, of the body while the vehicle is traveling a canted curved path and allows occurance of the relative movements tending to be produced between the body and the running gear, comprising: the resilient means being independent pneumatic springs of the diaphragm type having air inlet and exhaust means for level adjustment, and means operatively associated with the air inlet and exhaust means for effectively reducing flow of air therethrough and maintaining the springs distorted vertically and the body tilted in response to the centrifugal force arising during travel of a canted curved path, said means being operative only when the train reaches a speed above a predetermined minimum, and only when the track has a sufficient predetermined degree of curvature to thereby reduce the passenger feeling of unbalanced centrifugal force.

2. An improved pendular suspension system according to claim 1, in which said means for effectively reducing the inlet and exhaust of compressed air in the diaphram type air springs are being effected by way of restrictor means, said restrictor means effecting recovery of the nominal height of the springs as modified by uncompensated centrifugal force on a curve only after a longer period than that required to pass through the transition curves encountered in a railway network.

3. An improved pendular suspension system according to claim 1, in which two pneumatic springs are used for each running gear frame with one level adjustment valve for each spring ensuring that its level is maintained at a basically constant value, a cut off valve being positioned between each spring and its associated level adjustment valve, and sensing means controlling said valve to prevent the supply of air to the springs and the exhaust of air from the springs to atmosphere on running through a curve.

4. An improved pendular suspension system, according to claim 1, in which two pneumatic springs are used for each running gear frame with one level adjustment valve for each spring to maintain its level at a basically constant value, the said valves operating with a predetermined delay, exceeding in use, the time elapsing between the point at which the load unbalance is produced requiring the intake and exhaust of air, until the cut-off valve is actuated.

5. An improved pendular suspension system, according to claim 4, wherein the curve radius is detected by detector means responsive to relative longitudinal displacement between front ends of adjacent coaches, said detector means being arranged to transmit a suitable signal when the said displacement exceeds a predetermined minimum value.

6. An improved pendular suspension system, according to claim 5, wherein the said curve radius-detecting means are located at head and rear ends of a train, arranged respectively to activate and de-activate the control circuit for the cut-off valves on entering and leaving each curve.

* * * * *